US010883290B2

(12) United States Patent
Burt et al.

(10) Patent No.: US 10,883,290 B2
(45) **Date of Patent: *Jan. 5, 2021**

(54) VERTICAL CABLE RAIL BARRIER

(71) Applicant: Fortress Iron, LP, Garland, TX (US)

(72) Inventors: Kevin T. Burt, Dallas, TX (US); Matthew Carlyle Sherstad, Dallas, TX (US)

(73) Assignee: Fortress Iron, LP, Garland, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/689,502

(22) Filed: Aug. 29, 2017

(65) Prior Publication Data

US 2017/0362854 A1 Dec. 21, 2017

Related U.S. Application Data

(63) Continuation of application No. 14/684,810, filed on Apr. 13, 2015, now Pat. No. 9,790,707.

(Continued)

(51) Int. Cl.
*E04H 17/02* (2006.01)
*E04H 17/04* (2006.01)

(Continued)

(52) U.S. Cl.
CPC ..... *E04H 17/04* (2013.01); *E04F 11/1859* (2013.01); *E04H 17/06* (2013.01); *E04H 17/161* (2013.01); *E04H 17/24* (2013.01)

(58) Field of Classification Search
CPC ..... E04H 17/04; E04H 17/24; E04H 17/161; E04H 17/06; E04H 17/10; E04H 17/12; E04F 11/1859; F16B 1/00

(Continued)

(56) References Cited

U.S. PATENT DOCUMENTS 56,766 A 7/1866 Larmore
607,410 A 7/1898 Flanagan (Continued)

FOREIGN PATENT DOCUMENTS

DE 10 2011 121 073 3/2013
FR 3000531 7/2014

(Continued)

OTHER PUBLICATIONS

Shank—Definition of Shank by Merriam-Webster. Dictionary [online]. Merriam-Webster, 2019 [retrieved on Nov. 26, 2019]. Retrieved from the Internet: <URL: www.merriam-webster.com/dictionary/shank > (Year: 2019).*

(Continued)

*Primary Examiner* — Matthew R McMahon
(74) *Attorney, Agent, or Firm* — Foley & Gardner LLP

(57) ABSTRACT

A barrier panel is formed of a first rail member and a second rail member with at least one vertical support member mounted to and extending between the first rail member and second rail member. The first rail member includes first openings spaced apart along its length. The second rail member includes second openings spaced apart along its length. Vertical cables are mounted to and extend between the first rail member and second rail member. A first end of each vertical cable is secured within one of the first openings and a second end of each vertical cable is secured within an opposite one of the second openings. End members configured to adjust tension in the vertical cables are concealed by a pair of leg members of the second rail member.

19 Claims, 11 Drawing Sheets

Related U.S. Application Data

(60) Provisional application No. 61/979,055, filed on Apr. 14, 2014.

(51) Int. Cl.

| | |
|---|---|
| ***E04H 17/16*** | (2006.01) |
| ***E04H 17/24*** | (2006.01) |
| ***E04F 11/18*** | (2006.01) |
| ***E04H 17/06*** | (2006.01) |

(58) Field of Classification Search
USPC ..... 256/22, 32, 37, 59, 65.01, 65.02, 65.15, 256/69, DIG. 5
See application file for complete search history.

(56) References Cited

U.S. PATENT DOCUMENTS

| | | | | |
|---|---|---|---|---|
| 753,227 | A | 3/1904 | Bounds | |
| 1,714,388 | A | 5/1929 | McBride | |
| 3,313,527 | A | 4/1967 | Eriksson | |
| 3,955,799 | A | 5/1976 | Lauzier | |
| 4,190,234 | A | 2/1980 | Coleman | |
| 4,433,831 | A | 2/1984 | Bunger | |
| 5,186,497 | A * | 2/1993 | Van Pinkerton, Jr. | B42D 17/00 281/49 |
| 5,613,664 | A | 3/1997 | Svalbe | |
| 5,649,688 | A | 7/1997 | Baker | |
| 6,135,424 | A | 10/2000 | Bracke | |
| 6,679,480 | B1 | 1/2004 | Hara et al. | |
| 6,902,151 | B1 | 6/2005 | Nilsson | |
| 6,962,328 | B2 | 11/2005 | Bergendahl | |
| 6,964,138 | B2 | 11/2005 | Carroll et al. | |
| 7,044,448 | B1 | 5/2006 | Jones | |
| 7,168,689 | B2 | 1/2007 | Giralt | |
| 7,198,253 | B2 * | 4/2007 | Striebel | E04F 11/1834 254/231 |
| 7,249,908 | B2 | 7/2007 | Bergendahl et al. | |
| 7,889,075 | B2 | 2/2011 | Winkler et al. | |
| 7,913,983 | B1 | 3/2011 | Sandor, Sr. | |
| 7,988,133 | B2 | 8/2011 | Grippe et al. | |
| 8,157,471 | B2 | 4/2012 | Bergendahl et al. | |
| 8,814,145 | B2 | 8/2014 | Herman | |
| 9,145,705 | B2 | 9/2015 | Herman | |
| 9,194,155 | B2 | 11/2015 | Landry | |
| 9,689,410 | B2 | 6/2017 | Ostervig | |
| 10,450,774 | B2 * | 10/2019 | Herman | E04H 17/24 |
| 2006/0151760 | A1 | 7/2006 | Vyvyan-Vivian | |
| 2008/0106408 | A1 | 5/2008 | Winkler et al. | |
| 2009/0050865 | A1 | 2/2009 | Napier | |
| 2009/0321699 | A1 | 12/2009 | Payne | |
| 2010/0012910 | A1 * | 1/2010 | Napier | E01F 13/022 256/34 |
| 2010/0219390 | A1 * | 9/2010 | O'Banion | E01F 13/028 256/1 |
| 2010/0278609 | A1 | 11/2010 | Wreford | |
| 2010/0288991 | A1 | 11/2010 | DeRogatis et al. | |
| 2010/0301297 | A1 | 12/2010 | Chapman | |
| 2010/0308293 | A1 | 12/2010 | Larkins et al. | |
| 2011/0073823 | A1 * | 3/2011 | Mitrovic | E04H 17/1439 256/24 |
| 2011/0109025 | A1 | 5/2011 | Sechler | |
| 2012/0168703 | A1 | 7/2012 | Napier | |
| 2013/0020546 | A1 | 1/2013 | Truckner | |
| 2013/0069026 | A1 | 3/2013 | Bergendahl et al. | |
| 2014/0138596 | A1 | 5/2014 | Ross | |
| 2014/0332745 | A1 | 11/2014 | Marconi | |
| 2015/0204104 | A1 | 7/2015 | Ostervig | |
| 2015/0252588 | A1 | 9/2015 | Springborn | |
| 2020/0080620 | A1 * | 3/2020 | Graber | B21F 9/00 |

FOREIGN PATENT DOCUMENTS

| | | | | |
|---|---|---|---|---|
| GB | 413928 | A * | 7/1934 | E04C 2/14 |
| GB | 2420544 | A * | 5/2006 | A62B 1/04 |
| WO | WO-2004/037492 | A1 | 5/2004 | |
| WO | WO-2007/124533 | A1 | 11/2007 | |

OTHER PUBLICATIONS

Shank—Definition in the Cambridge English Dictionary. Dictionary [online]. Cambridge, 2019 [retrieved on Nov. 26, 2019]. Retrieved from the Internet: <URL: https://dictionary.cambridge.org/us/dictionary/english/shank> (Year: 2019).*

American Heritage Dictionary Entry: Swage. Dlcitonary [online]. American Heritage Dictionary—Houghton Mifflin Harcourt, 2019 [retrieved on Dec. 10, 2019]. Retrieved from the Internet: <URL: https://andicitonary.com/word/search.html?q=swage> (Year: 2019).*

International Search Report and Written Opinion for PCT/US2015/025563 dated Jul. 14, 2015 (11 pages).

Extended European Search Report for corresponding European Patent Application No. 15780190.3 dated May 8, 2018, 9 pages.

* cited by examiner

VERTICAL CABLE RAIL BARRIER

PRIORITY CLAIM

This application is a continuation of U.S. patent application Ser. No. 14/684,810, filed on Apr. 13, 2015, now U.S. Pat. No. 9,790,707, which claims priority from U.S. Provisional Application for Patent No. 61/979,055 filed Apr. 14, 2014, the disclosures of which are incorporated by reference.

BACKGROUND OF THE INVENTION

Technical Field of the Invention

The present invention relates generally to barriers (such as railings or fences) and in particular to a barrier panel utilizing cables as vertical barrier members.

Description of Related Art

It is common to form a barrier for railing or fence applications made, for example, of a plurality of panel members, with each panel member supported between and attached to a pair of post members. Each panel generally comprises a bottom rail extending between two posts and a top rail also extending between those same two posts. A plurality of vertical support members (also referred to in the art as pickets or balusters) extend between the bottom rail and the top rail. The bottom rail, top rail and vertical support members are made of a metal material (such as steel or aluminum). In an embodiment, first ends of the vertical support members are fixedly attached to the bottom rail (for example, through bolts, brackets or welding) and second ends of the vertical support members are fixedly attached to the top rail (again, for example, through bolts, brackets or welding).

The panel may be pre-assembled before delivery to a job site. In such a case, the installer may simply install the pair of posts with a separation substantially equal to a length of the panel. The installed posts should have an exposed height that is greater than a height of the panel. Brackets mounted on each post accept and retain ends of the bottom and top rails.

SUMMARY

In an embodiment, an apparatus comprises: a bottom rail member including a plurality of first openings spaced apart along a length of the bottom rail member; a top rail member including a plurality of second openings spaced apart along a length of the top rail member; at least one vertical support member mounted to and extending between the bottom rail member and top rail member; and a plurality of vertical cables mounted to and extending between the first rail member and second rail member, wherein a first end of each vertical cable is secured within one of the first openings and a second end of each vertical cable is secured within an opposite one of the second openings. End members configured to adjust tension in the vertical cables are concealed by a pair of leg members of the second rail member.

In an embodiment, an apparatus comprises: a rail member including: an outer U-shaped channel; and an inner U-shaped channel; wherein said inner U-shaped channel is mounted within the outer U-shaped channel with open ends of the inner and outer U-shaped channels facing each other; inner openings spaced apart along the length of the inner U-shaped channel; and outer openings spaced apart along the length of the outer U-shaped channel; wherein each inner opening is aligned with a corresponding outer opening; and a plurality of cables mounted to said rail member, wherein an end of each cable is secured within aligned inner and outer openings.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION

Figure 1:
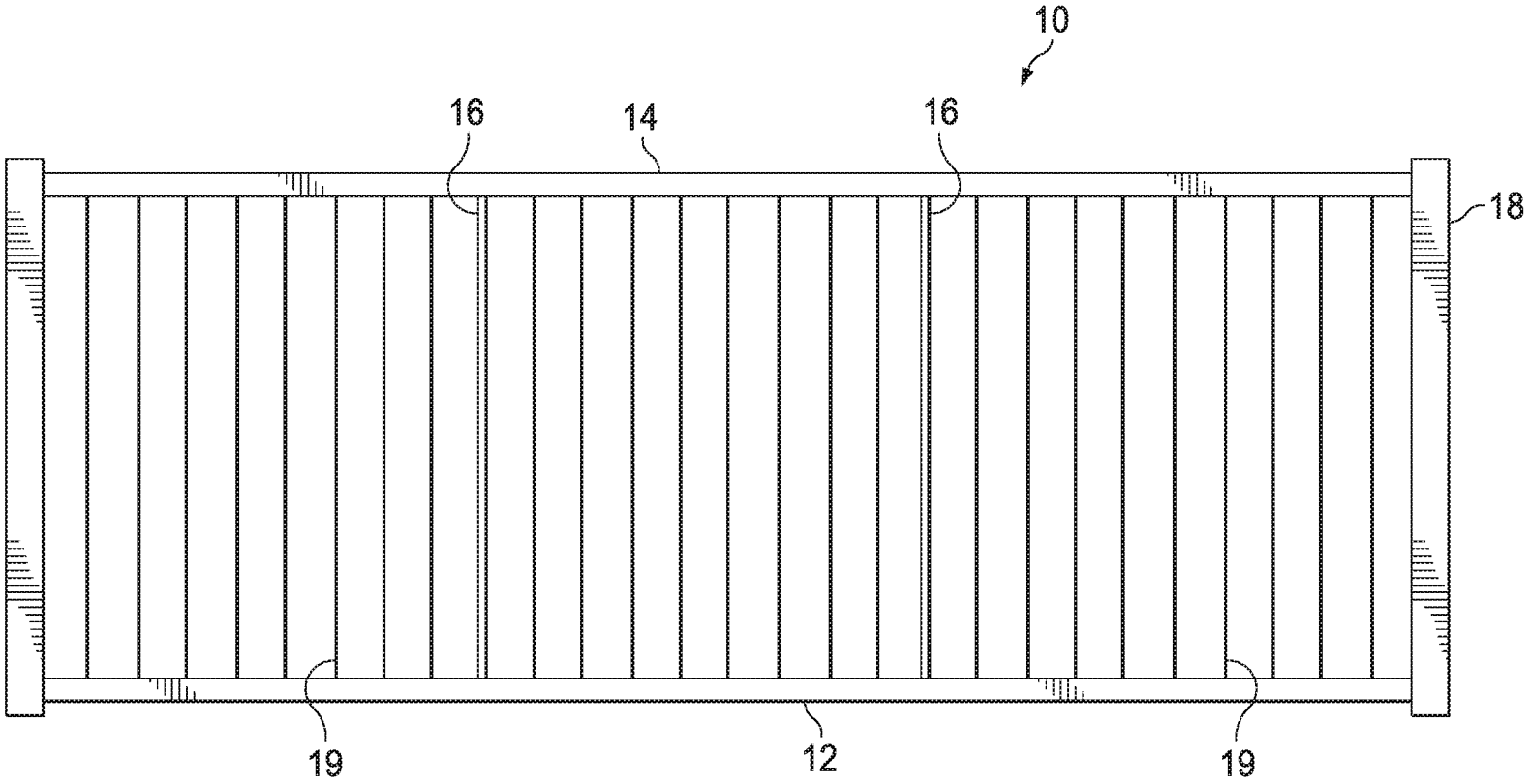
FIG. 1 is a front view of an embodiment of a cable rail panel.

Reference is now made to FIG. 1 which illustrates a front view of an embodiment of a cable rail panel 10 (configured to be installed between two post members 18). The panel 10 includes a bottom rail 12 and a top rail 14 that are spaced apart from each other by a pair of vertical support members 16 (extending between the bottom and top rails) which are spaced apart from each other along the lengths of the bottom and top rails. The bottom rail 12, top rail 14 and vertical support members 16 are made of a metal material (such as steel or aluminum). First ends of the vertical support members are fixedly attached (for example, by bolts, welding or brackets) to the bottom rail 12. Second ends of the vertical support members are fixedly attached (also, for example, by bolts, welding or brackets) to the top rail 14. The panel 10 further includes a plurality of vertical cables 19 spaced apart from each other along the lengths of the bottom and top rails and extending between the bottom and top rails. The means for cable attachment will be discussed in more detail herein. Each end of the bottom and top rails is configured for attachment to the post member 18, for example, through the use of a bracket mechanism as known in the art.

In an embodiment, the vertical support members 16 are hollow tubular members having a desired cross-section including, for example, square, rectangular, circular, hexagonal, octagonal, or the like. In an alternative embodiment, the vertical support members 16 are solid bar members having a desired cross-section including, for example, square, rectangular, circular, hexagonal, octagonal, or the like. In either case, a threaded opening may be provided at each end of the member 16 to accept a mounting bolt for attachment of the vertical member to the top and bottom rails.

Figure 2:
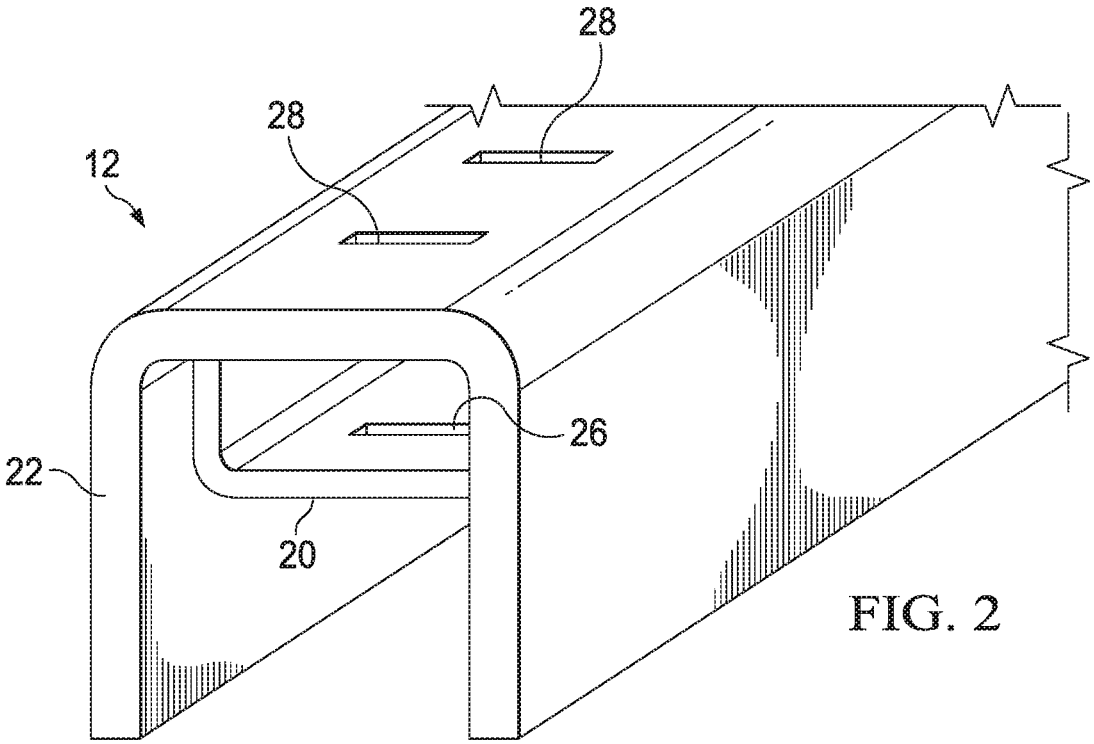
FIG. 2 is a perspective view of a bottom rail.
Figure 3:
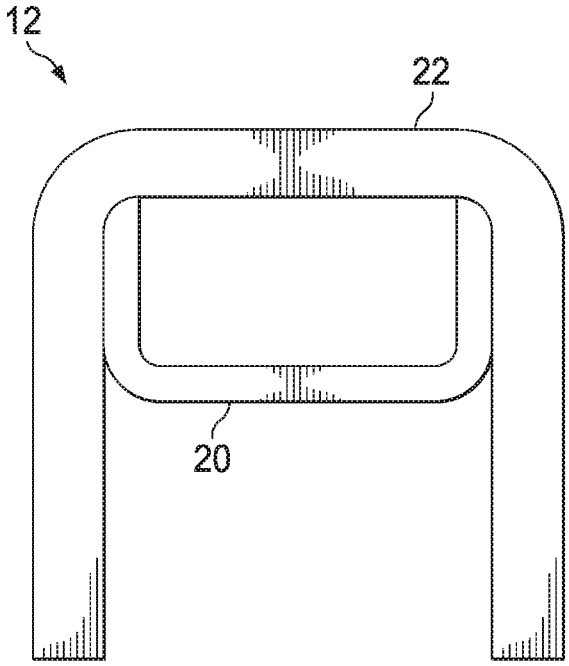
FIG. 3 is a cross-sectional view of the bottom rail.

Reference is now made to FIG. 2 which illustrates a perspective view of the bottom rail 12 and further to FIG. 3 which illustrates a cross-sectional view of the bottom rail 12.

The bottom rail is formed of a first U-shaped channel member 20 and a second U-shaped channel member 22. The channel members 20 and 22 are made of a metal material, such as steel or aluminum, and are fixedly attached to each other (for example, by welding) with the first channel member 20 fitting within the second channel member 22 and the open ends of the two channel members oriented facing each other. The welded attachment may, for example, comprise welding edges or surfaces of the channel member 20 to inner surfaces of the channel member 22. Spot or resistance welding techniques may be used in a manner well known to those skilled in the art. In a preferred implementation, evidence of the welding would not be visible on an outer surface of the channel member 22.

Each channel member 20 and 22 is formed of a web member and an opposed pair of leg members extending generally perpendicularly from the web member. The space between the leg members defines the open end of the channel member. The web member for the first channel member 20 includes a plurality of first openings 26 and the web member for the second channel member 22 includes a plurality of second openings 28. When the channel members 20 and 22 are fixedly attached to each other, the first and second openings 26 and 28 align with each other. Furthermore, with reference once again to FIG. 1, the aligned first and second openings are provided at locations along the lengths of the channel members 20 and 22 which corresponding to the desired locations of vertical cables 19 (and also the desired locations of the vertical support members 16 in a certain embodiment). Indeed, as will be discussed in more detail below, the first and second openings 26 and 28 are provided in connection with supporting the attachment of first ends of the plurality of vertical cables 19 to the bottom rail 12 (and perhaps attachment of first ends of the vertical support members 16).

The openings 26 and 28 may have any desired shape, but in a preferred implementation the openings have square or rectangular cross-sectional shapes.

The first channel member 20 functions to provide reinforcement or stiffness to the assembly with the second channel member 22 to form the bottom rail 12. The first channel member 20 further functions in connection with supporting bottom rail 12 for retention of first ends of the plurality of vertical cables 19.

Figure 4:
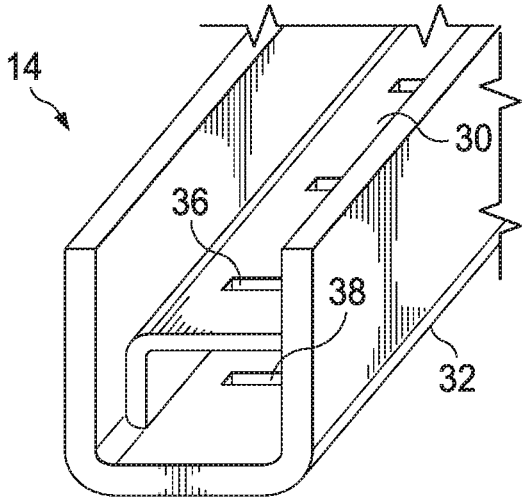
FIG. 4 is a perspective view of a top rail.

Reference is now made to FIG. 4 which illustrates a perspective view of the top rail 14 (the cross-section of top rail being similar to that of the bottom rail shown in FIG. 3). The top rail is formed of a first U-shaped channel member 30 and a second U-shaped channel member 32. The channel members 30 and 32 are made of a metal material, such as steel or aluminum, and are fixedly attached to each other (for example, by welding) with the first channel member 30 fitting within the second channel member 32 and the open ends of the two channel members oriented facing each other. The welded attachment may, for example, comprise welding edges or surfaces of the channel member 30 to inner surfaces of the channel member 32. Spot or resistance welding techniques may be used in a manner well known to those skilled in the art. In a preferred implementation, evidence of the welding would not be visible on an outer surface of the channel member 32.

Each channel member 30 and 32 is formed of a web member and an opposed pair of leg members extending generally perpendicularly from the web member. The web member for the first channel member 30 includes a plurality of first openings 36 and the web member for the second channel member 32 includes a plurality of second openings 38. When the channel members 30 and 32 are fixedly attached to each other, the first and second openings 36 and 38 align with each other. Furthermore, with reference once again to FIG. 1, the aligned first and second openings are provided at locations along the lengths of the channel members 30 and 32 which corresponding to the desired locations of vertical cables 19 (and also the desired locations of the vertical support members 16 in a certain embodiment). Indeed, as will be discussed in more detail below, the first and second openings 36 and 38 are provided in connection with supporting the attachment of second ends of the plurality of vertical cables 19 to the top rail 14 (and perhaps attachment of second ends of the vertical support members 16).

The openings 36 and 38 may have any desired shape, but in a preferred implementation the openings have square or rectangular cross-sectional shapes.

The first channel member 30 functions to provide reinforcement or stiffness to the assembly with the second channel member 32 to form the top rail 14. The first channel member 30 further functions in connection with supporting top rail 14 retention of second ends of the plurality of vertical cables 19.

Figure 5A:
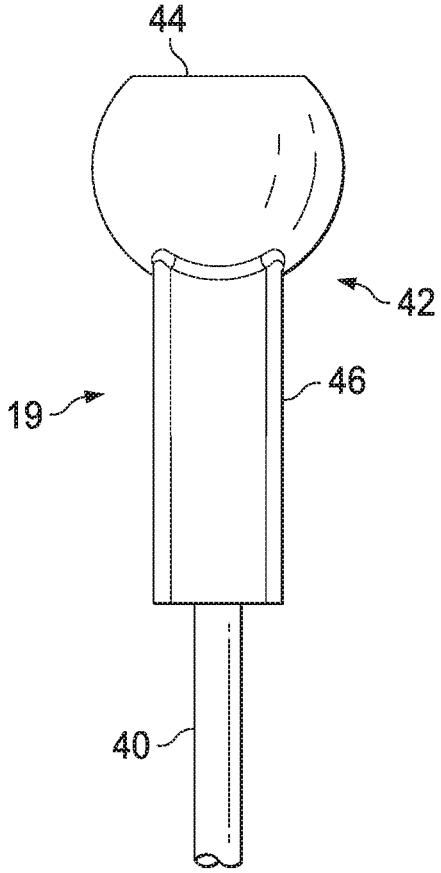
FIG. 5A illustrates a first end of a cable.

Reference is now made to FIG. 5A which illustrates a first end of a vertical cable 19. The cable 19 is formed of a cable member 40 that is made of metal, for example, stainless steel. The cable member 40 may be of a wound, woven or solid (rod) type as desired and is to some degree flexible along its length. At the first end, a ball swage fitting 42 is attached. The ball swage fitting 42 includes a ball member 44 and a shank member 46. The shank member 46 is a hollow tubular member sized to receive the end of the cable member 40 which is fixedly attached within the shank member 46. The shank member 46 may, for example, have an outer shape in the form of a square or rectangle generally conforming to the size and shape of the openings 26 and 28 provided in the bottom rail 12 (or alternatively the openings 36 and 38 of the top rail 14). The ball member 44 is sized larger than the openings 26 and 28 (or 36 and 38).

Figure 5B:
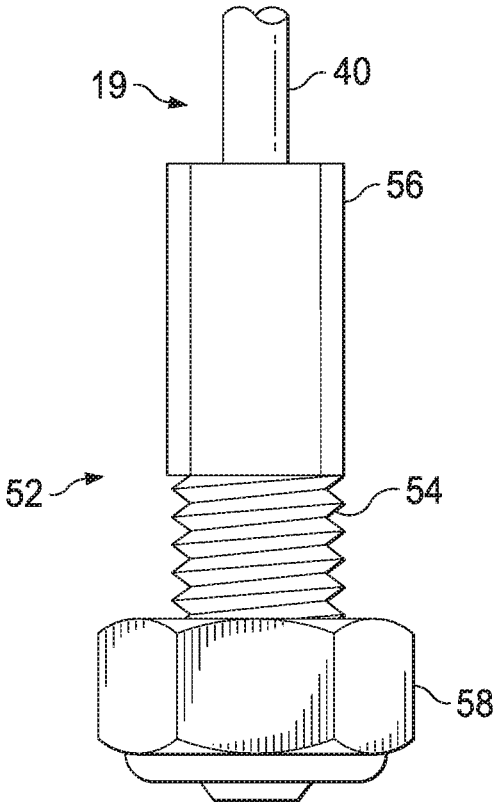
FIG. 5B illustrates a second end of a cable.

Reference is now made to FIG. 5B which illustrates a second end of a vertical cable 19. The cable 19 is formed of the cable member 40 as described above. At the second end, a threaded swage fitting 52 is attached. The threaded swage fitting 52 includes a threaded member 54 and a shank member 56. The shank member 56 is a hollow tubular member sized to receive the end of the cable member 40 which is fixedly attached within the shank member 56. The shank member 56 may, for example, have an outer shape in the form of a square or rectangle generally conforming to the size and shape of the openings 36 and 38 provided in the top rail 14 (or alternatively the openings 26 and 28 provided in the bottom rail 12). The threaded member 54 likewise is sized to fit through the openings 36 and 38 (or 26 and 28). A nut 58 is provided to be installed on the threaded member 54 and it is sized larger than the openings 36 and 38 (or 26 and 28).

Figure 6A:
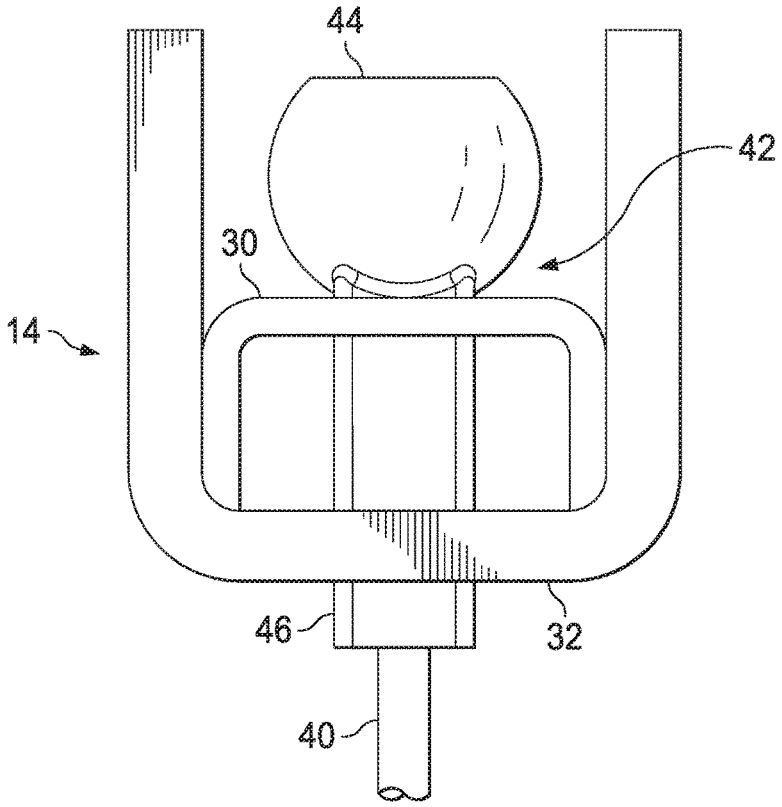
FIGS. 6A-6D illustrate cable installation on the bottom and top rails.

Reference is now made to FIG. 6A which illustrates an end view of top rail 14 with an installed ball swage fitting 42. The ball member 44 is sized larger than the opening 36 in the first channel member 30 and the shank member 46 is sized for press fit through the openings 36 and 38 in the channel members 30 and 32. FIG. 6C shows a perspective view of the installed ball swage fitting 42 extending through the openings 38 in the top rail 14. It will be understood that alternatively the fitting 42 could be used in connection the bottom rail 12.

Figure 6B:
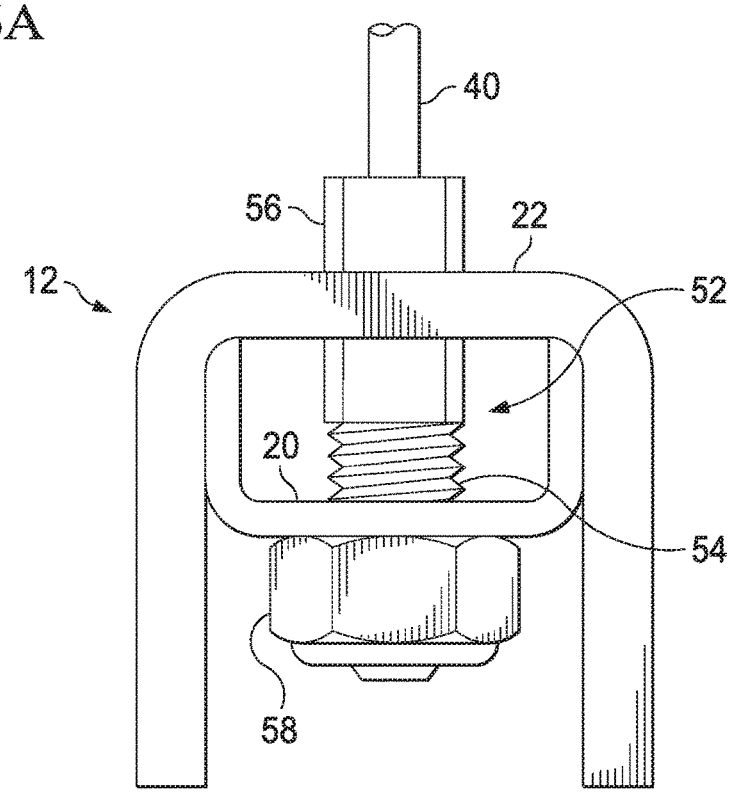
Figure 6C:
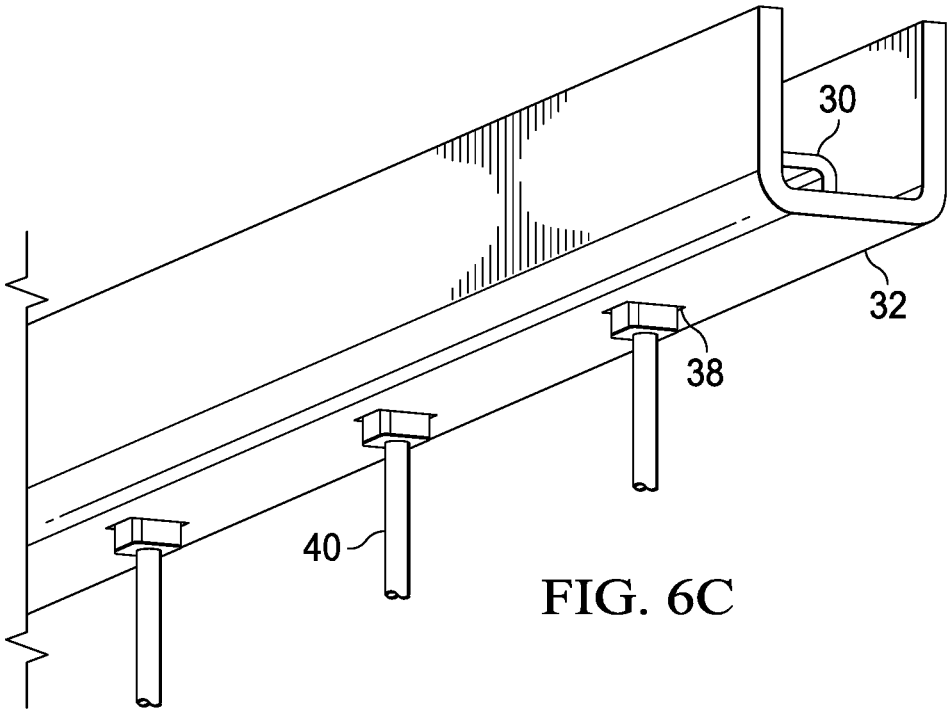
Figure 6D:
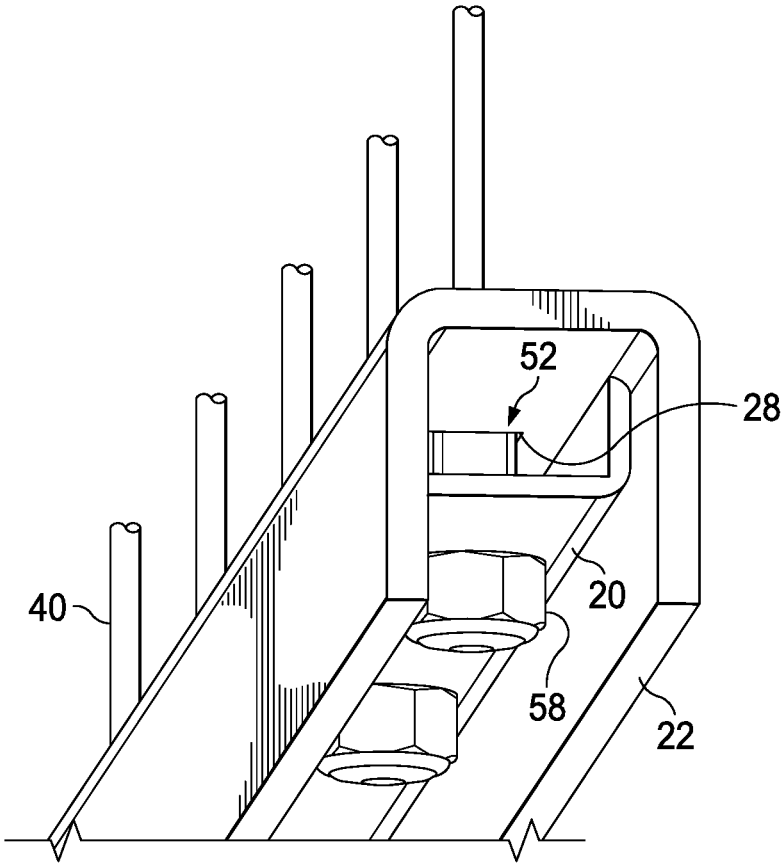

Reference is now made to FIG. 6B which illustrates an end view of bottom rail 12 with an installed threaded swage fitting 52. The nut 58 is sized larger than the opening 26 in the first channel member 20 and the shank member 56 and threaded member 54 are sized to pass freely through the openings 26 and 28 in the channel members 20 and 22. Tightening of the nut 58 on the threaded member 54 permits adjustments to be made as to the tensioning of the cable 19. FIG. 6D shows a perspective view of the installed threaded swage fittings 52. It will be understood that alternatively the fitting 52 could be used in connection the top rail 14 (see, for example, FIGS. 9 and 10).

Figure 7:
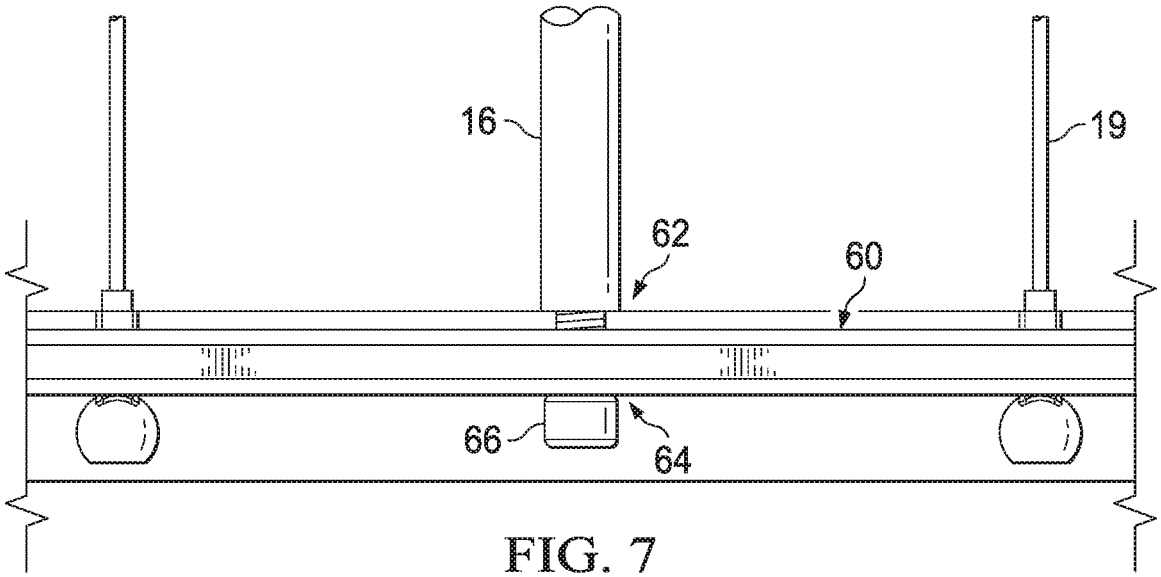
FIG. 7 is a broken away side view showing a means for attaching vertical support members.

Reference is now made to FIG. 7 which illustrates a means for attaching the vertical support members 16 to the bottom rail 12 and top rail 14. FIG. 7 shows a rail member 60 which may comprise either a bottom rail 12 or a top rail 14. The rail member 60 has a configuration like that shown in FIGS. 2 and 4 and thus includes a plurality of aligned openings 62 and 64 in channel members 20 and 22 used for supporting installation of the swage fittings. Instead of fixedly attaching the vertical support member 16 by means of welding, the vertical support member 16 may instead be secured to the rail member 60 at any of the opening 62/64 locations using mounting hardware 66. In an embodiment, the mounting hardware 66 may, for example, comprise a bolt, screw or other threaded connector as known in the art. The shaft of such hardware passes through the openings 62/64 and engages a threaded opening provided in the end of the vertical support member. The head of such hardware engages with the inner channel member. An advantage of this assembly is that the vertical support members 16 can be installed at any opening along the length of the top and bottom rail members. Thus, rail members can be cut to desired length at the job site and the one or more vertical support members 16 provided at desired locations along that length. One end of each of the plurality of cables 19 is then installed in the remaining openings 62/64 to complete assembly of the panel as shown in FIG. 1 wherein the ends of each cable are supported with opposite openings in the rails 12 and 14.

Figure 8:
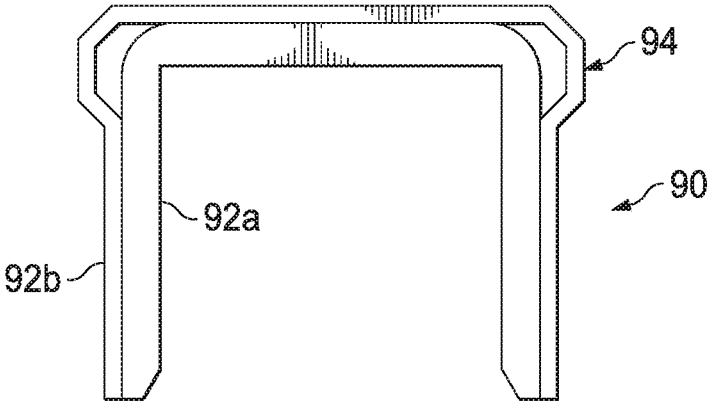
FIG. 8 illustrates an end view of a cap member.
Figure 9:
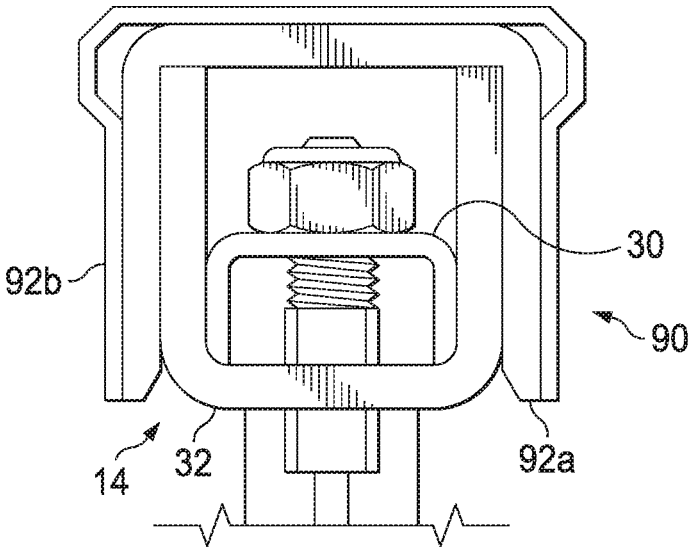
FIG. 9 illustrates installation of the cap member.

Reference is now made to FIG. 8 which illustrates an end view of a cap member 90 that is configured for installation over the top rail 14. FIG. 9 illustrates the cap member 90 in an installed position. The cap member 90 is formed of one or more U-shaped channel members 92 which may comprise a base member 92*a* and an ornamental member 92*b*. The base member 92*a* is designed for press or interference fit over the channel member 32. The ornamental member 92*b* is secured to the base member 92*a* through any suitable means (including, for example, welding, adhesion, hardware like screws, etc.) and includes ornamental features 94 as desired (only one non-limiting example of such ornamentation being shown).

Figure 10:
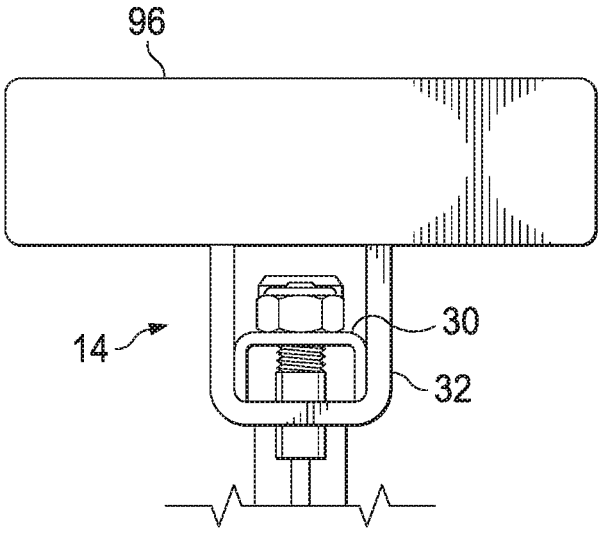
FIG. 10 illustrates an alternative cap member.

In an alternative embodiment, the open end of the top rail 14 may be closed or covered using other means. For example, FIG. 10 illustrates the use of a wooden member 96 which can be secured to the top rail 14 using any suitable means (including, for example, a clip mechanism and hardware attachment).

Although the ball end of the swage fitting may be configured for mounting to openings in the bottom rail, it will be understood that this is a matter of installation choice and instead the ball end of the swage fitting could be mounted to openings in the top rail. Although the threaded end of the swage fitting may be configured for mounting to openings in the top rail, it will be understood that this is a matter of installation choice and instead the threaded end of the swage fitting could be mounted to openings in the bottom rail.

Figure 11A:
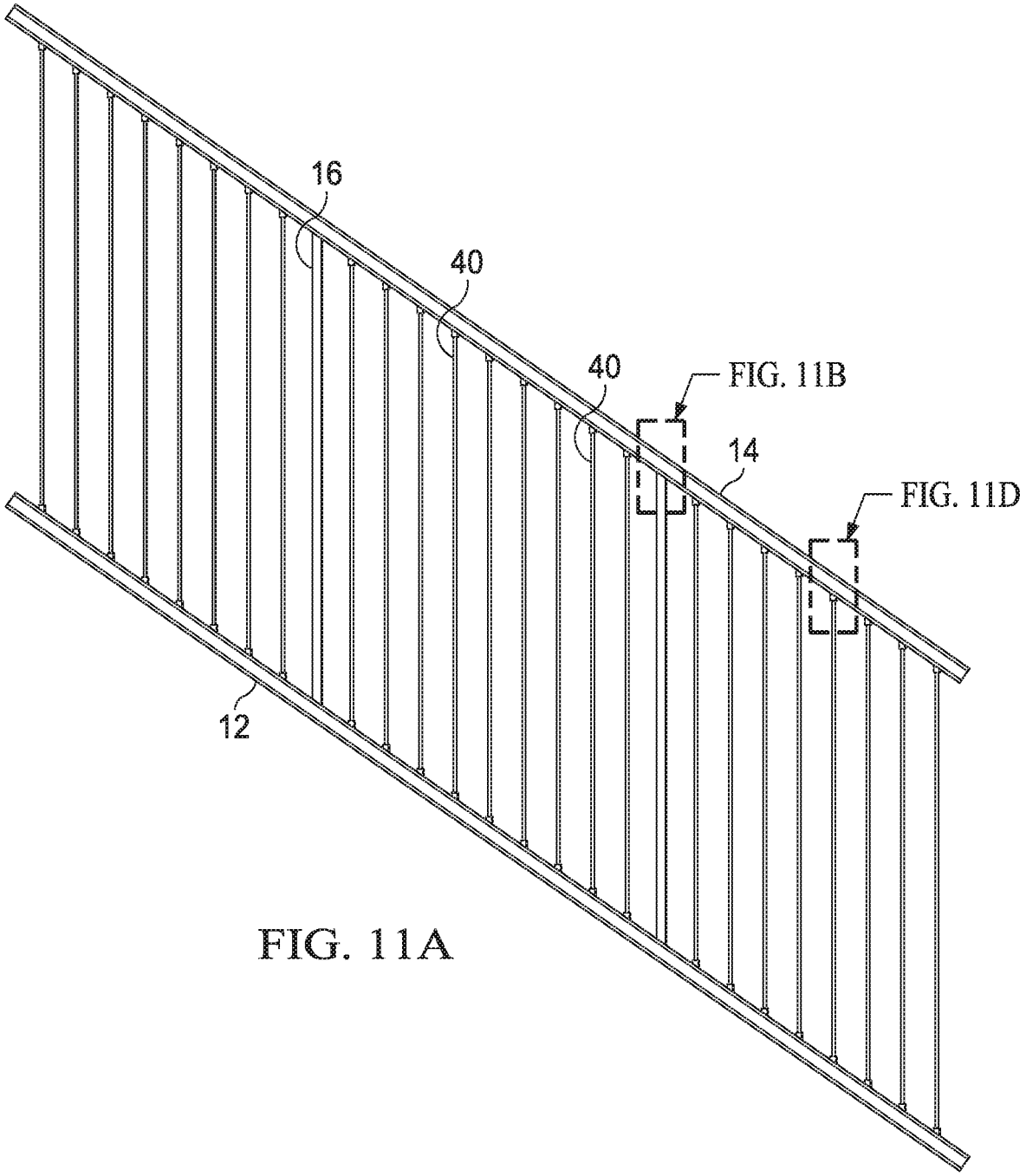
FIGS. 11A-11E illustrate an implementation of the cable rail panel useful in a stair or sloped installation.
Figure 11B:
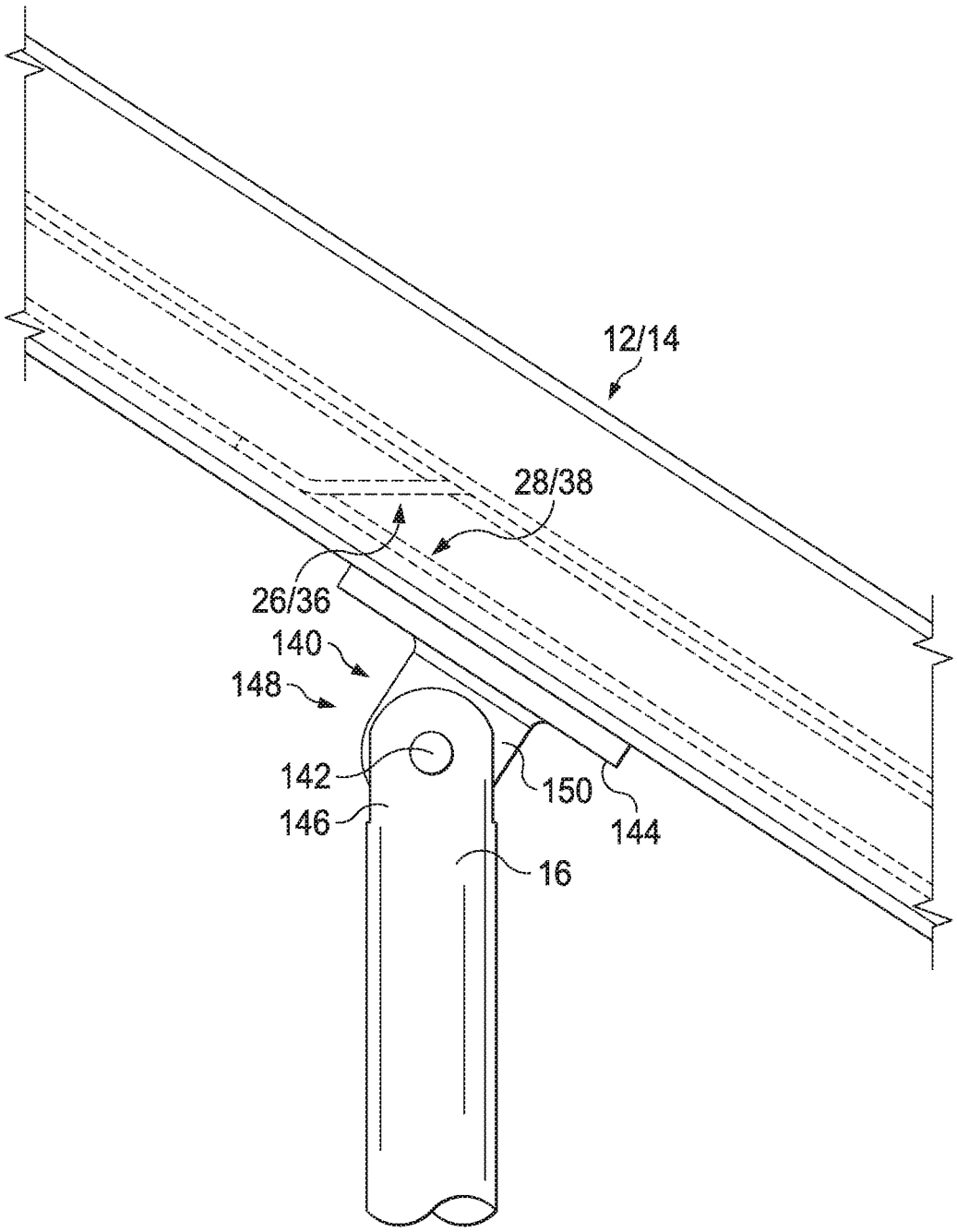
Figure 11C:
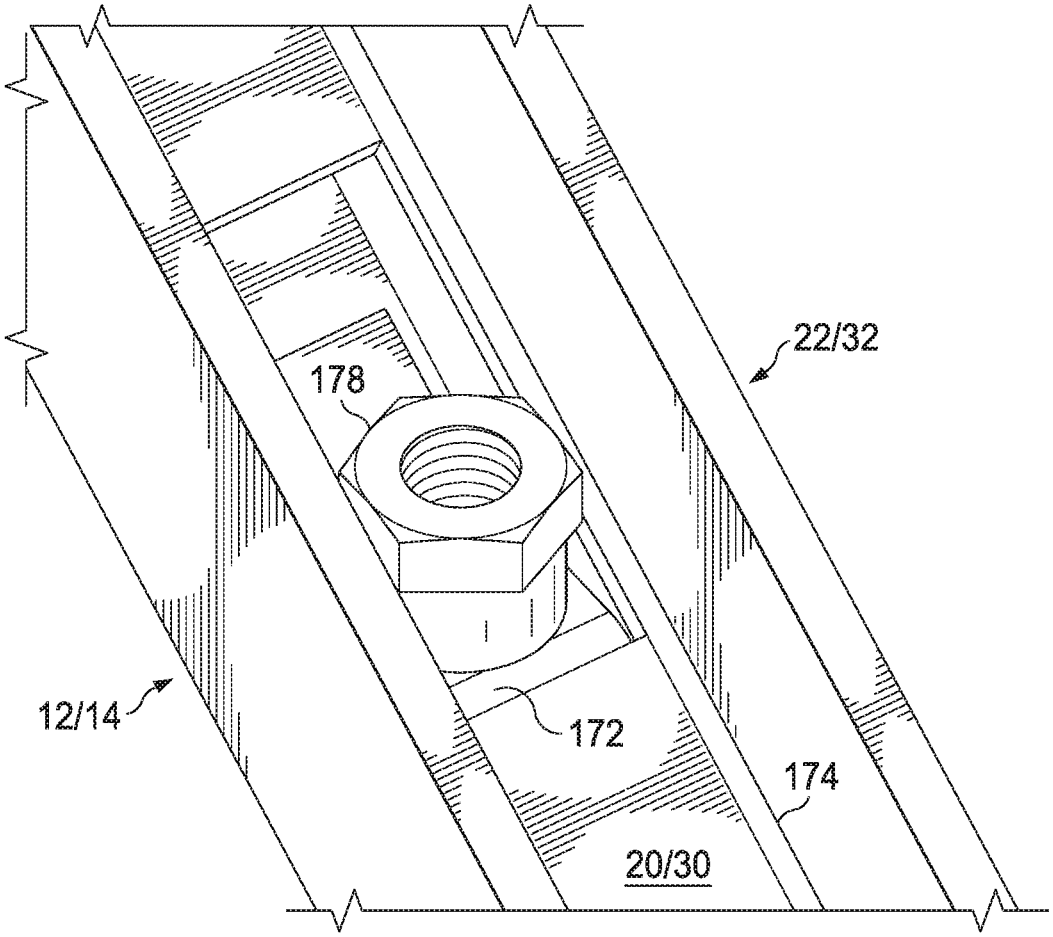
Figure 11D:
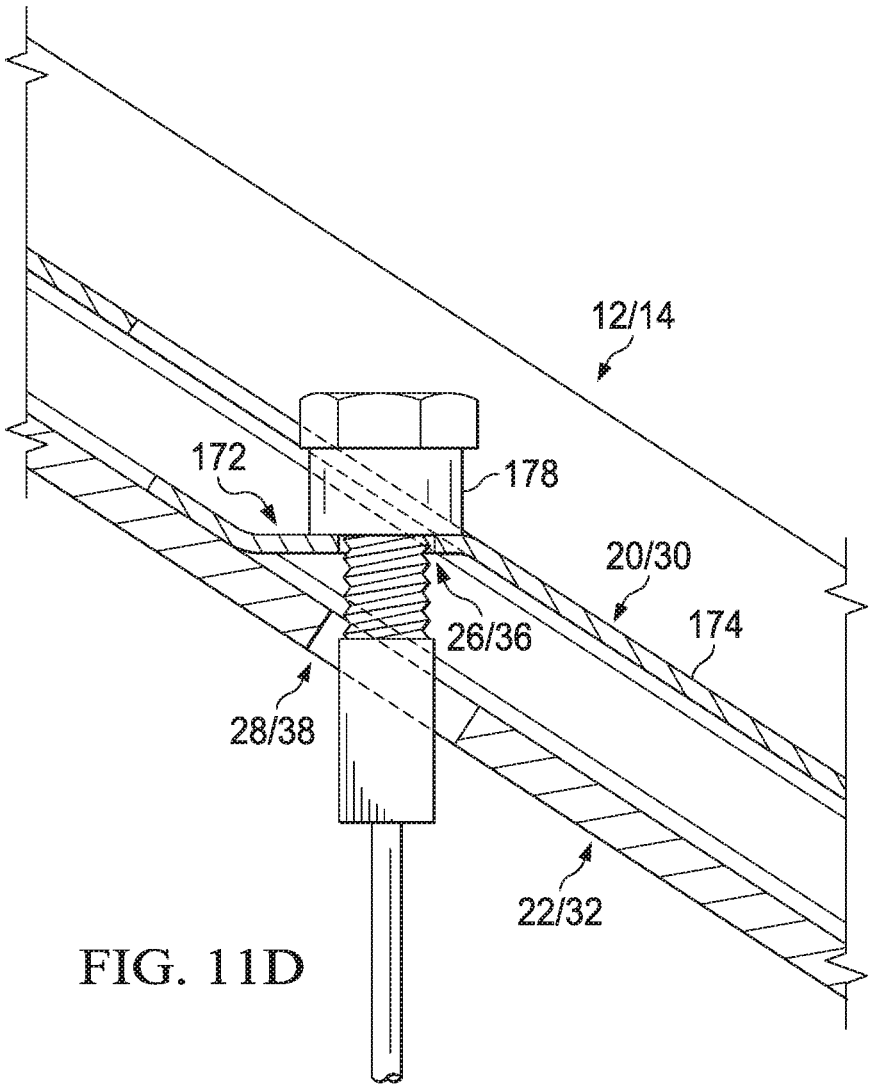
Figure 11E:
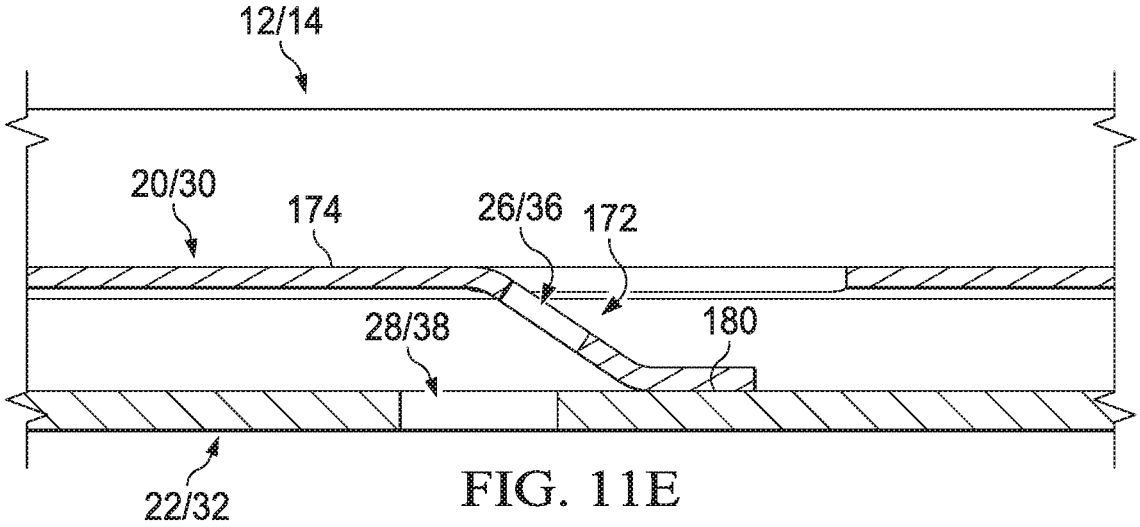

There may exist certain installations, such as with stairs or other sloped terrain, where a perpendicular panel configuration like that shown in FIG. 1 is not preferred. In such cases, it would be preferred to install a panel that is configured to have the top and bottom rails and cables of the panel run parallel to the slope as shown in FIG. 11A.

The panel 10 is accordingly configured to support racking so as to follow undulating terrain, stairways or ramps. For example, the panel may be racked to an angle up to about 35°. In this configuration, the connection between the vertical support members 16 and both the bottom rail 12 and top rail 14 permits other than perpendicular mounting. Additionally, the brackets used to attach the ends of the bottom rail 12 and top rail 14 to the posts 18 permits other than perpendicular mounting. More detail is provided below and in connection with FIGS. 11B-11E.

To support this installation, the panel includes a hinge 140 for connecting the ends of the vertical support members 16 to each of the rails 12 and 14. See, FIG. 11B. The hinge 140 provides a pivot point 142 between a rail bracket 144 and a support bracket 146. In the illustrated configuration, the support bracket 146 includes a pair of opposed flanges 148 and the rail bracket 144 includes a tab member 150 that is inserted between and pivotally coupled to the flanges 148. The rail bracket 144 may be attached to the rail 12/14 using the openings 26/28 or 36/38 and mounting hardware. The support bracket 146 may be attached to an end of the support member 16 using mounting hardware, or alternatively may be integrally formed at the end of the support member 16.

In order to support angled attachment of the ends of the cable, the top and bottom rails 12/14 are configured such that an angled tab 172 is cut out from the web member 174 of the first channel member 20/30 at each opening 26/36. See, FIGS. 11C-11E. A first end of the angled tab 172 remains attached to the web member 174 while a second end of the angled tab 172 is bent inwardly towards the web member 176 of the second channel member 22/32. In an embodiment, the second end of the angled tab 172 is engaged (for example, by welding) against the inner surface of the web for the second channel member 22/32 (as shown at reference 180). The opening 26/36 still aligns with the opening 28/38 on the second channel member 22/32 and receives the fitting 178 which is attached to the cable end (see, FIGS. 5A-5B for examples of the fittings). The angle with which the tab 172 is bent may, in a preferred embodiment, be equal to about 30-40°. It will be understood that the angle of the tab 172 may be selected to account for the slope of the stairs or sloped terrain at which the panel is to be installed. The alignment of the openings 26/36 and 28/38 is made in accordance with a range of permitted slope installations. To support such a range, the opening 28/38 in the second channel member is oversized with respect to the fitting.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

The invention claimed is:

1. A barrier, comprising:

a top rail comprising a top web portion and a pair of top leg portions extending from the top web portion, the top web portion defining a plurality of top through holes spaced apart along the top web portion;

a bottom rail comprising a bottom web portion and a pair of bottom leg portions, the bottom web portion defining a plurality of bottom through holes spaced apart along the bottom web portion and aligned with the top through holes;

a rigid support member vertically extending between the top rail and the bottom rail;

a first vertical cable disposed adjacent the rigid support member, a top end of the first vertical cable received in and directly attached to a hollow tubular shank of a first top swage fitting and a bottom end of the first vertical cable received in and directly attached to a hollow tubular shank of a first bottom swage fitting, the top end of the first vertical cable extending through one of the plurality of top through holes, and the bottom end of the first vertical cable extending through one of the bottom through holes disposed in vertical alignment with the one top through hole;

a second vertical cable disposed adjacent the rigid support member, a top end of the second vertical cable received in and directly attached to a hollow tubular shank of a second top swage fitting and a bottom end of the second vertical cable received in and directly attached to a hollow tubular shank of a second bottom swage fitting, the top end of the second vertical cable extending through another of the plurality of top through holes, and the bottom end of the second vertical cable extending through another of the bottom through holes disposed in vertical alignment with the another top through hole; and wherein the first and second bottom swage fittings are each coupled to a respective adjustable end member, each one of the pair of bottom leg portions extending beyond and concealing the adjustable end members therebetween, wherein adjusting the adjustable end member adjusts a tension in the respective first and second vertical cables.

2. The barrier of claim 1 wherein the first and second bottom swage fittings are each threaded.

3. The barrier of claim 1 further comprising a ball coupled to each of the first and second top swage fittings.

4. The barrier of claim 3 wherein the balls are larger in size than the top through holes.

5. The barrier of claim 1 wherein at least one end of the rigid support member includes a threaded opening, and further including a threaded connector configured to engage with the threaded opening and mount the at least one end of the rigid support member to the bottom rail.

6. The barrier of claim 1 wherein the top and bottom rails, the rigid support member, the first vertical cable, and the second vertical cable are pre-assembled to form a barrier panel.

7. The barrier of claim 1 wherein the first and second bottom swage fittings extend through the bottom through holes.

8. The barrier of claim 1 wherein each adjustable end member is a female threaded member.

9. The barrier of claim 8 wherein each adjustable end member is a nut.

10. A vertical cable barrier, comprising:

a first rail member including a plurality of first openings spaced apart along a length of the first rail member;

a second rail member, comprising a U-shaped channel defined by a web member and an opposed pair of leg members, the web member defining a plurality of second openings spaced apart along a length of the web member; and at least one vertical support member mounted to and extending between the first rail member and the second rail member;

a plurality of vertical cables mounted to and extending between the first rail member and the second rail member, wherein a first end of each vertical cable is secured within one of the first openings and a second end of each vertical cable is secured within one of the second openings; and a swage fitting including a hollow tubular shank receiving and directly attached to the second end of each vertical cable, each swage fitting coupled to a female threaded member larger in size than the second openings and each of the pair of opposed leg members extending beyond the female threaded members such that the female threaded members are concealed by and disposed between the opposed pair of leg members, each female threaded member adjusting a tension in the respective vertical cable.

11. The vertical cable barrier of claim 10 further comprising a second swage fitting secured to the first end of each vertical cable.

12. The vertical cable barrier of claim 10 wherein the second rail member further includes an inner U-shaped channel defined by an inner web member and an opposed pair of inner leg members, the inner U-shaped channel mounted within the U-shaped channel with open ends of the U-shaped channels facing each other, the inner web member having inner openings spaced apart along a length of the inner web member, each inner opening being aligned with a corresponding opening formed in the web member.

13. The vertical cable barrier of claim 10 wherein the first rail member, the second rail member, the at least one vertical support member, and the plurality of vertical cables are pre-assembled to form a barrier panel.

14. The vertical cable barrier of claim 10 wherein each swage fitting extends through the respective second opening.

15. A barrier, comprising:

a first rail having a first web member and an opposed pair of first leg members and an offset web member disposed offset from and aligned with the first web member, the offset web member defining first through holes disposed spaced apart along the offset web member;

a second rail disposed spaced apart and aligned with the first rail, the second rail comprising:

an outer U-shaped channel defined by an outer web member and an opposed pair of outer leg members, the outer web member defining a plurality of outer through holes spaced apart along the outer web member; and an inner U-shaped channel defined by an inner web member and an opposed pair of inner leg members, the inner U-shaped channel mounted within the outer U-shaped channel, the inner web member having inner through holes spaced apart along the inner web member, each inner through hole being aligned with a corresponding outer through hole formed in the outer web member;

a plurality of rigid support members extending between and disposed spaced apart along the first and second rails;

a plurality of vertical cables disposed along the first and second rails among the plurality of rigid support members, each vertical cable mounted to and extending between the first rail and the second rail, wherein a first end of each vertical cable is secured within one of the first through holes and a second end of each vertical cable is secured within opposite aligned inner and outer through holes of the second rail member; and a swage fitting secured to each of the second ends of each vertical cable, each swage fitting threadedly coupled to a nut disposed within the opposed pair of outer leg members.

16. The barrier of claim 15 further comprising a second swage fitting secured to the first ends of each vertical cable and disposed within the pair of first leg members.

17. The barrier of claim 15 wherein the first and second rails, the plurality of rigid support members, and the plurality of vertical cables are pre-assembled to form a barrier panel.

18. The barrier of claim 15 wherein each of the rigid support members includes a threaded opening, and further including a threaded connector engaged with the threaded opening and mounting the rigid support members to the second rail.

19. The barrier of claim 15, wherein the inner U-shaped channel is welded within the outer U-shaped channel.

* * * * *